US006495254B1

(12) United States Patent
Abe et al.

(10) Patent No.: US 6,495,254 B1
(45) Date of Patent: Dec. 17, 2002

(54) POLY(TRIMETHYLENE TEREPHTHALATE) FIBER

(75) Inventors: Takao Abe, Nobeoka (JP); Youichiro Azuma, Nobeoka (JP); Teruhiko Matsuo, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/913,645

(22) PCT Filed: Mar. 14, 2000

(86) PCT No.: PCT/JP00/01553

§ 371 (c)(1),
(2), (4) Date: Aug. 17, 2001

(87) PCT Pub. No.: WO00/55403

PCT Pub. Date: Sep. 21, 2000

(30) Foreign Application Priority Data

Mar. 15, 1999 (JP) ..... 11-068672

(51) Int. Cl.[7] ..... D01F 6/00; D01F 6/62; B22D 28/00; B27B 17/00

(52) U.S. Cl. ..... 428/364; 428/395; 264/130; 264/210.3; 264/211.14

(58) Field of Search ..... 428/364, 395; 264/103, 210.3, 211.14

(56) References Cited

U.S. PATENT DOCUMENTS 6,340,525 B1 * 1/2002 Akamatsu et al. ..... 428/395
6,423,407 B1 * 7/2002 Abe ..... 428/364

FOREIGN PATENT DOCUMENTS

| | | |
|---|---|---|
| JP | 52005320 | 1/1977 |
| JP | 52008123 | 1/1977 |
| JP | 52008124 | 1/1977 |
| JP | 53-090641 | 8/1978 |
| JP | 58104216 | 6/1983 |
| WO | WO99/29041 | 8/1999 |

* cited by examiner

*Primary Examiner*—Newton Edwards
(74) *Attorney, Agent, or Firm*—Finnegan, Henderson, Farabow, Garrett & Dunner, L.LP.

(57) ABSTRACT

According to the present invention, polytrimethylene terephthalate fiber is provided, which is high in toughness, uniform in fiber size and excellent in dyeing uniformity, whereby it is extremely suitable for a clothing use.

Polytrimethylene terephthalate fiber according to the present invention can be produced by a two-step method consisting of a low speed spinning process and a drawing process, wherein the winding condition of undrawn fiber, the atmospheric condition under which the undrawn fiber is retained and the time for retaining the undrawn fiber are set to a specific range so that the shrinkage of undrawn fiber with time and the transformation of the undrawn package caused thereby are minimized. Thus, the unwinding tension of the undrawn fiber is maintained constant whereby the drawing is favorably carried out to result in a high quality polytrimethylene terephthalate fiber.

3 Claims, 8 Drawing Sheets

POLY(TRIMETHYLENE TEREPHTHALATE) FIBER

TECHNICAL FIELD

The present invention relates to a polytrimethylene terephthalate fiber (hereinafter referred to as PTT fiber), which is a kind of polyester fiber, and a method for producing the same. Specifically, it relates to a so-called two-step method for producing PTT fiber wherein polytrimethylene terephthalate is melt-spun and once taken up as an undrawn fiber after which it is drawn to be the PTT fiber and the PTT fiber thus obtained has a high uniformity suitable for a clothing use. More specifically, it relates an atmospheric condition and a time period for maintaining the undrawn fiber in the above-mentioned method for producing the same.

BACKGROUND ART

Polyester fibers mainly composed of polyethylene terephthalate have widely been produced, all over the world, as synthetic fibers most suitable for clothing use, and the polyester fiber industry has already developed into a major industrial field.

On the other hand, PTT fiber has long been studied, but it has not yet reached full-scale industrial production because of a high price of trimethylene glycol which is one of raw materials thereof in the prior art. In this regard, a method has recently been invented, for producing trimethylene glycol at a low cost, whereby there is a possibility of industrialization.

PTT fiber is expected to be an epoch-making fiber having the advantages of polyester fiber and nylon fiber, and the application thereof has been studied for clothing use or carpet use in which the advantages thereof are desirable.

PTT fiber has long been known in the prior art and, for example, from Japanese Unexamined Patent Publications (Kokai) No. 52-5320 (A), No. 52-8123 (B), No. 52-8124 (C), NO. 58-104216 (D), J. Polymer Science: Polymer Physics Edition Vol., 14, 263 to 274 (1976) (E), and Chemical Fibers International Vol., 45, April (1995) 110 to 111 (F).

In these prior arts, PTT fiber is produced by a so-called two-step method and there is the following description in (D) which is technically similar to the present invention:

"Since PTT undrawn fiber produced by an ordinary production method, i.e., at a spinning rate of lower than 2000 m/min has extremely low degrees of orientation and crystallization and a glass transition point as low as 35° C., the properties thereof very quickly change with time whereby it is difficult to obtain PTT fiber having favorable properties because of the generation of fluff or neps during a drawing process."

A method is proposed in (D) as a technique for avoiding this problem, wherein a spinning rate is 2000 m/min or higher, preferably 2500 m/min or higher to develop the degrees of orientation and crystallization and a drawing temperature is maintained in a range from 35 to 80° C. Also, there is an example in (D) wherein an undrawn fiber obtained at a spinning rate of 3,500 m/min is drawn after being left for 24 hours under the condition of 20° C. and 60% RH.

Although there is a description in (D) that the structure and physical properties of the undrawn fiber spun at a spinning rate lower than 2000 m/min significantly vary with time at a room temperature to directly disturb the drawing stability, there are neither descriptions nor suggestions of countermeasure for avoiding adverse effects caused by such a variation with time of the undrawn fiber obtained at a spinning rate of lower than 2000 m/min, not to speak of concrete means for suppressing such variation with time within a minimum limit to obtain a high quality fiber while maintaining a favorable drawing stability.

From the description of Examples in (D), PTT fiber resulted from the method of (D) has a toughness of 18 (cN/dtex)$\%^{1/2}$ or less, from which it will be apparent that the mechanical property is poorer.

In a comparative example disclosed in (D), a description is seen in that an undrawn fiber spun at a spinning rate of 1200 m/min was left in the atmosphere at 20° C. and 60% RH, and thereafter drawn to be a drawn fiber having a toughness of as low as 18 (cN/dtex)$\%^{1/2}$, however, there is no description on the variation value of fiber size (U%) or the periodic fluctuation thereof.

As a result of studies according to the present inventors, it was found that when PTT fiber is produced by the two-step method wherein a spinning rate is 1900 m/min or less, a shrinkage of the resultant undrawn fiber varies with atmospheric temperature and time as shown in FIGS. 1 and 2. It was also found that if the variation of shrinkage with time is large, an undrawn fiber package transforms from a normal shape as shown in FIG. 3A to an abnormal shape as shown in FIG. 3B due to the shrinkage as the time lapses, and lengths of the undrawn fiber in the package are partially adhered to each other to disturb the smooth unwinding of the undrawn fiber, which results in the large fluctuation of unwinding tension and the generation of many yarn breakages or single-filament breakages to worsen the drawing stability. Note that, in FIGS. 3A and 3B, reference numeral 1 denotes the undrawn fiber and 2 denotes a bobbin for taking up the undrawn yarn.

Also, it was apparent that the drawn yarn obtained from the undrawn fiber wound in the package transformed due to the variation of shrinkage with time generally has a large variation value of fiber size, i.e., U%, and the periodic fluctuation thereof corresponding to a traverse width of a take-up winder for the undrawn fiber (2 to 5 m as converted to the drawn fiber) or integral times thereof (see FIGS. 4A and 5A). A knit or woven fabric made of such a drawn fiber having the large U% and the periodic fluctuation of fiber size is in general unevenly dyed to exhibit a periodic dyeing speck or luster which is apparently unsuitable for a clothing use in which the uniformity is the most important property.

Generally speaking, in the industrial production of synthetic fiber by the two-step method, maximally three or four days are required for completing the drawing after the undrawn fiber has been taken up, whereby influence of the variation in shrinkage with time is substantially inevitable. Accordingly, the industrial production of PTT fiber suitable for the clothing use is impossible under the condition wherein the variation in shrinkage with time is significant as in the above manner.

DISCLOSURE OF THE INVENTION

An object of the present invention is to provide a high-quality PTT fiber suitable for clothing use obtained by a two-step method, which can be drawn in a stable manner (to result in a high yield), high in toughness and low in variation of fiber size, particularly in periodic fluctuation of fiber size, preferable for an apparel, excellent in quality, and a method for industrially producing such PTT fiber. A problem to be solved by the present invention is to suppress the shrinkage of the undrawn fiber with time as much as possible, to reduce the fluctuation of unwinding tension of the undrawn fiber and to eliminate the adverse effect on the drawing stability of the undrawn fiber and on the quality of the drawn fiber.

As a result of diligent study, the present inventors found the relationship between the atmospheric condition (temperature and relative humidity) in which PTT undrawn fiber is retained and the shrinkage variation of the undrawn fiber with time as well as the relationship between the atmospheric condition and the drawing stability or the quality of the drawn fiber. The present invention has completed based on such a knowledge.

That is, a first aspect of the present invention is a twisted or non-twisted PTT fiber high in uniformity, having an intrinsic viscosity in a range from 0.7 to 1.3, composed of 95 mol % or more of repeated units of trimethylene terephthalate and 5 mol % or less of repeated units of other ester, characterized in that a toughness of the fiber is 19 (cN/dtex) $\%^{1/2}$ or more and a variation value of fiber size (U%) during the continuous measurement of the fiber size by an evenness tester is 1.5 or less as well as the fiber exhibits either one of characteristics defined by the following requisites (1), (2) and (3);

(1) a periodic variation on the smaller fiber size side at an interval of 10 m or less exists in an evenness tester chart, and a magnitude of the variation is 2% or less of an average fineness, (2) while the existence of the periodic variation on the smaller fiber size side at an interval of 10 m or less is not discernible from the evenness tester chart, a periodic variation at an interval of 10 m or less exists in a diagram for analyzing the period of fiber size variation, and (3) no periodic variation on the smaller fiber size side at an interval of 10 m or less is discernible from the evenness tester chart, and no periodic variation at an interval of 10 m or less exists in the diagram for analyzing the period of fiber size variation.

(Note the toughness is calculated from the equation of strength at break×elongation at break$^{1/2}$ (cN/dtex)$\%^{1/2}$, and a length of fiber to be measured by the evenness tester is 250 m.)

A second aspect of the present invention is a method for producing a fiber from PTT having an intrinsic viscosity in a range from 0.7 to 1.3, composed of 95 mol % or more of repeated units of trimethylene terephthalate and 5 mol % or less of those of other ester by a two-step method wherein an undrawn fiber is once taken up in a spinning process as a package form at a take-up rate of 1900 m/min or less and then drawn in a drawing process, characterized in that the undrawn fiber is taken up at a take-up tension in a range from 0.04 to 0.12 cN/dtex, and retained in an environmental atmosphere having a temperature in a range from 10 to 25° C. and a relative humidity in a range from 75 to 100% during a winding process, a storage process and a drawing process, and in that the drawing of the undrawn fiber is completed within 100 hours after the undrawn fiber has been taken up.

The present invention will be described in more detail below.

The present invention is a method for producing a fiber from PTT having an intrinsic viscosity in a range from 0.7 to 1.3, composed of 95 mol % or more of repeated units of trimethylene terephthalate and 5 mol % or less of those of other ester by a two-step method wherein an undrawn fiber is once taken up in a spinning process as a package form at a take-up rate of 1900 m/min or less and then drawn in a drawing process, and a twisted or non-twisted PTT filament fiber obtained by the above method.

In general, the drawing operation in the two-step method is carried out by a so-called draw twister shown in FIG. 7 or a draw winder shown in FIG. 8, and a drawn fiber is wound as a pirn (shown in FIG. 9) in the former or as a cheese (shown in FIG. 10) in the latter. Generally speaking, the fiber wound in the pirn is twisted, while the fiber wound in the cheese is non-twisted. In FIGS. 7 and 8, reference numeral 15 denotes an undrawn package, 16 a supply roll, 17 a hot plate, 18 a draw roll, 19 a pirn and 20 a cheese. Also, in FIG. 9, reference numerals 21 and 22 denote a bobbin and a drawn fiber, respectively. In FIG. 10, reference numerals 23 and 24 denote a paper tube and a drawn fiber, respectively.

In the first aspect of the present invention, the toughness is 19 (cN/dtex)$\%^{1/2}$ or more. If the toughness is less than 19 (cN/dtex)$\%^{1/2}$, mechanical properties such as a tearing strength of a knit or woven fabric obtained by processing the PTT fiber becomes too inferior to be used for clothing. A preferable value of the toughness is 21 (cN/dtex)$\%^{1/2}$ or more. In this regard, the toughness of polyethylene terephthalate fiber for general clothing use is approximately 24 (cN/dtex)$\%^{1/2}$.

In the first aspect of the present invention, a variation value of fiber size (U%) during the continuous measurement of the fiber size by an evenness tester is 1.5% or less. If the U% exceeds 1.5%, physical properties of the fiber become uneven to result in a streaky or irregularly dyed knit or woven fabric. U% is preferably 1.2% or less, more preferably 1.0% or less.

It is thought that the undrawn fiber obtained under conditions wherein a package of the undrawn fiber is significantly transformed due to the shrinkage with time has a large variation in size of undrawn fiber to worsen the U%.

According to the first aspect of the present invention, there is a periodic variation on a smaller fiber size side at an interval of 10 m or less on a chart obtained by the continuous measurement of a fiber size by an evenness tester, and a magnitude of the variation is 2% or less relative to an average fiber size. This corresponds to the above-mentioned requisite (1).

The confirmation of whether or not the periodicity exists in the variation of fiber size may be possible by directly reading a chart of the continuous measurement of fiber size (Diagram Mass) or through an analysis of the periodic variation in fiber size (Spectrogram Mass) described later. In the latter, if there is a peak in CV value representing a variance of the fiber size (shown in a vertical axis of the analysis diagram) exceeding approximately 0.2% between 1 m and 10 m of a length of period (shown in a horizontal axis of the analysis diagram), it is said that the periodicity exists in the variation of fiber size.

The periodic variation on the smaller fiber size side is a variation corresponding to downward whisker-like signals generating at an equal interval on a continuous measurement chart of fiber size shown in FIG. 4A. A fact that the signals generated at an equal interval are observed at the equal interval means that the fluctuation of fiber size causing the signals periodically occurs, and the existence of a downward signal means that a fiber size (a fineness of fiber) at that point as seen in the lengthwise direction of the fiber varies to a smaller side. A ratio of the periodic variation on a smaller fiber size side relative to the average fiber size is directly readable from the chart. If this ratio exceeds 2%, a knit or woven fabric suitable for a clothing use is not obtainable from this fiber even though the U% is 1.5% or less, because the dyeing speck and the unevenness of luster become significant due to this periodic variation of fiber size.

An interval of the period variation of fiber size substantially corresponds to a product of one traverse stroke or two between opposite ends of an undrawn fiber package and a draw ratio. It is surmised that a length of undrawn fiber existing at opposite ends or one end of the package is drawn due to the unwinding resistance to cause the periodic variation of fiber size on the smaller fiber size side. In the two-step method, the interval of the periodic variation of fiber size is determined by a traverse stroke, a winding angle and a draw ratio of a winder for the undrawn fiber and, in general, is 10 m or less.

When the periodic variation of fiber size on the smaller fiber size side becomes small, the downward signals generated at the equal pitch are not discernible on the continuous measurement chart of fiber size as shown in FIG. 4B. However, in a period analysis diagram (shown in FIG. 5B) corresponding to FIG. 4B, there are signals representing the existence of the periodic variation. The above-mentioned requisite (2) defines such a phenomenon that signals are not discernible in the chart but are represented in the period analysis diagram. In the diagram shown in FIG. 5B, four signals, i.e., those projecting like mountains exist in an area of the horizontal axis shorter than 10 m. This state, wherein one mountain-like signal, or more, is visible, is a state wherein the periodic variation exists in fiber size on the period analysis diagram as defined in the requisite (2). In this regard, according to the period analysis, it could not be determined whether or not the signals belong to the smaller fiber size side or the larger fiber size side. The range satisfying the requisite (2) is a favorable range of the present invention.

If the periodic variation of fiber size becomes further smaller, no mountain-like signal is visible even in the periodic analysis diagram. This state is one showing the characteristic of the requisite (3). That is, the range satisfying the requisite (3) is a more favorable range of the present invention.

In the second aspect of the present invention, a winding tension of the undrawn fiber in the spinning process is 0.04 to 0.12 cN/dtex. If the winding tension is within this range, no significant transformation of the package results even though the undrawn fiber slightly contracts with time. If the atmospheric temperature is retained at a relatively high value within a range defined by the present invention, the winding tension is preferably set at a relatively low level. On the other hand, if the atmospheric temperature is retained at a relatively low value, the winding tension is preferably set at a relatively high level.

If the winding tension is less than 0.04 cN/dtex, it becomes difficult to wind up the undrawn fiber continuously because the fiber runs unstably. If the winding tension exceeds 0.12 cN/dtex, the transformation of the package is not avoidable due to the shrinkage of the undrawn fiber with time even though the environmental atmospheric temperature is retained in a range from 10 to 25° C.

According to the second aspect of the present invention, the winding, storage and drawing processes of the undrawn fiber are retained in the environmental atmosphere having a temperature in a range from 10 to 25° C. and a relative humidity in a range from 75 to 100%.

If the atmospheric temperature is lower than 10° C., the shrinkage of the undrawn fiber with time becomes extremely small, but the cost necessary for the temperature control increases as well as the working efficiency lowers due to the cold. On the contrary, if the atmospheric temperature exceeds 25° C., the shrinkage of the undrawn fiber with time becomes so large that the transformation of the package is not avoidable even though the winding tension is lowered to 0.04 cN/dtex.

A favorable range of the atmospheric temperature is from 15 to 22° C. in view of the transformation of the undrawn fiber package, the cost necessary for temperature control and the working efficiency.

In the second aspect of the present invention, the relative humidity of the atmosphere in which the undrawn fiber is retained during the respective processes is in a range from 75 to 100%. If the relative humidity is less than 75%, water imparted together with a finishing agent to the undrawn fiber package is promptly evaporated solely at the opposite ends of the package to lower the moisture content of the undrawn fiber in these portions, which results in the generation of much fluff in the drawn fiber as well as the rise in U% of the fiber exceeding 1.5% after being drawn whereby the unevenness or the streaky defect are significant in the dyed fabric. A more favorable range of the relative humidity is from 80 to 95%.

According to the second aspect of the present invention, it is necessary to complete the drawing of the undrawn fiber within 100 hours after the winding. The time from the initiation of the winding process to the completion of the drawing process, that is, a period from an instant at which a leading end of the undrawn fiber is wound at the innermost layer of the undrawn fiber package to an instant at which the leading end is drawn, is generally referred to as a lag time. The lag time must be within 100 hours in the present invention.

If the lag time exceeds 100 hours, water imparted to the undrawn fiber together with the finishing agent is partly evaporated to make the water content of the respective portions of the package unequal, while the shrinkage of the undrawn fiber with time is small to minimize the package transformation, whereby the U% of the drawn fiber becomes larger than 1.5% to result in the dyeing speck (the dyeing grade is lowered below a reject level). The lag time is preferably within 75 hours, more preferably within 50 hours.

A detailed description will be given for PTT polymer according to the present invention.

PTT according to the present invention is composed of 95 mol % or more of repeated units of trimethylene terephthalate and 5 mol % or less of those of other ester.

That is, the PTT according to the present invention is a copolymer composed of PTT homopolymer and other ester units of 5 mol % or less. A representative of the copolymer components is as follows:

An acidic component includes dicarbonic acid having sulfonic group, represented by 5-sodium sulfoisophthalic acid, and metallic salts thereof; aromatic dicarbonic acid represented by isophthalic acid; aliphatic dicarbonic acid represented by adipic acid, while a glycolic component includes ethylene glycol, butylene glycol and polyethylene glycol. A plurality of copolymeric components may be contained.

An intrinsic viscosity of PTT according to the present invention is in a range from 0.7 to 1.3. For a clothing use, a preferable range is from 0.8 to 1.1.

PTT according to the present invention may contain additives, such as a residual metal-type catalyst, a heat stabilizer, an antioxidant, a delusterant, a shade adjuster, a flame retardant, an ultraviolet inhibitor or others, which may be contained as copolymerized components.

A known method may be applied to produce PTT according to the present invention. In general, after being polymerized in a molten state, an intrinsic viscosity of the polymer may be further increased through the solid-phase polymerization.

In the production of PTT fiber according to the present invention, for example, a process shown in FIGS. 6 and 7 may be adopted.

In FIG. 6, PTT pellets dried in a dryer 3 to have a moisture content of 30 ppm or less is supplied to an extruder 4 set at a temperature in a range from 255 to 265° C. and melted therein. The molten PTT is fed through a bend 5 to a spin head 6 set at a temperature in a range from 250 to 265° C. and metered by a gear pump. Thereafter, PTT is extruded into a spinning chamber as a multifilament 9 through a spinneret 8 having a plurality of orifices and mounted to a spin pack 7.

An optimum temperature is selected from the above range as that of the extruder or the spin head in accordance with an intrinsic viscosity and a shape of the PTT pellet.

The PTT multifilament extruded into the spinning chamber is thinned by godet rolls 12, 13 rotating at predetermined speeds, while being quenched by a cooling air 10 to a room temperature, and solidified to be an undrawn fiber having a predetermined fiber size. Prior to being in contact with the godet roll 12, the undrawn fiber is imparted with a finishing agent by a finishing agent applicator 11. After departing from the godet roll 13, the undrawn fiber is taken up by a winder 14 to be an undrawn fiber package. A winding speed of the undrawn fiber is preferably in a range from 1000 to 1900 m/min.

In this process, an environmental atmosphere surrounding the godet rolls 12, 13 and the winder is maintained at a temperature in a range from 10 to 25° C. and a relative humidity in a range from 75 to 100%. Also, when it is necessary to temporarily store the undrawn fiber package thus formed prior to being delivered to a drawing process, the package is stored in the atmosphere with the above-mentioned conditions.

A winding tension of the undrawn fiber is adjustable by changing the winding speed; i.e., a ratio of the peripheral speed of the undrawn fiber package to that of the godet roll 13 during the winding operation.

The finishing agent is of an aqueous emulsion type which is safe for the working environment. A concentration of the finishing agent is preferably in a range from 10 to 30 wt %. When the aqueous emulsion type finishing agent is imparted, the undrawn fiber after being wound contains an amount of water in accordance with the concentration and the adhesion degree of the finishing agent. The moisture content is generally in a range from 3 to 5 wt %.

The undrawn fiber package is then delivered to a drawing process in which it is drawn by the draw twister as shown in FIG. 7. The undrawn fiber package 15 is retained in the atmosphere of the draw twister at a temperature in a range from 10 to 25° C. and a relative humidity in a range from 75 to 100% while being drawn. In the draw twister, the undrawn fiber 15 is first heated on the supply roll 16 having a temperature in a range from 45 to 65° C. and drawn by using a ratio of the peripheral speed of the draw roll 18 to that of the supply roll 16 to have a predetermined fiber size. The fiber runs during or after the drawing while being in contact with the hot plate 17 set at a temperature in a range from 100 to 150° C. to be subjected to a stretch heat treatment. The fiber exiting the draw roll is twisted by a spindle and wound to form the pirn 19.

In the above process, the ratio of the peripheral speed of the draw roll 18 to that of the supply roll 16, that is, the draw ratio, and the hot plate temperature are preferably set so that the drawing tension is approximately 0.35 cN/dtex.

BEST MODES FOR CARRYING OUT THE INVENTION

The present invention will be described with reference to Examples.

In this regard, methods and conditions for measuring physical properties are as follows:

(a) Intrinsic Viscosity

The intrinsic viscosity [η] is defined by the following equation:

$$[\eta] = \lim_{c \to 0} (\eta r - 1)/C$$

In the above equation, ηr is a value obtained by dividing a viscosity, measured at 35° C., of a solution of PTT polymer diluted with o-chlorophenol solvent having a purity of 98% or more by a viscosity of the above solvent at the same temperature, and is referred to as a relative viscosity. C is a polymer concentration represented by g/100 ml.

(b) Shrinking Percentage of Undrawn Fiber with Time (%)

Directly after being taken up, the undrawn fiber is wound 20 times around a counter reel having a peripheral length of 1.125 m to form a hank (a ring-like yarn bundle), which is left in an atmosphere of predetermined temperature and humidity for a predetermined period with no load.

Lengths of the hank are measured directly after forming the hank and after a predetermined time has passed (corresponding to the time passage after the undrawn fiber has been wound), and the shrinking percentage of the undrawn fiber with time is calculated by the following equation, wherein a load applied to the hank when the length thereof is measured is 22.5 mg/dtex:

$$\text{Shrinking percentage of undrawn fiber with time} = [(L1 - L2)/L1] \times 100$$

in which L1 is an initial length of the hank (cm) and L2 is a length of the hank after the predetermined period has passed (cm).

(c) Strength at Break, Elongation at Break and Toughness

A general purpose tensile tester is used for depicting a stress-strain curve under the test condition of a fiber gripping length of 50 cm and a stretching rate of 50 cm/min. The test is carried out five times and an average strength at break (cN/dtex) and an average elongation at break (%) are obtained. Therefrom, a toughness is calculate by the following equation:

Toughness=strength at break×elongation at break$^{1/2}$ $(cN/dtex)\%^{1/2}$ (d) Continuous Measurement of Variation of Fiber Size (Chart) and Fluctuation Value of Fiber Size (U%)

A chart of the continuous measurement of fiber size (Diagram Mass) is obtained by the following method, and simultaneously therewith, U% is measured.

Tester: Evenness Tester (Uster Tester 4 Manufactured by Zellweger Uster)

Measuring condition:

Yarn speed: 100 m/min

Number of twist: 10000 turns/min

Measured length of fiber: 250 m

Scale: determined in accordance with the fluctuation of fiber size.

Figure 1:
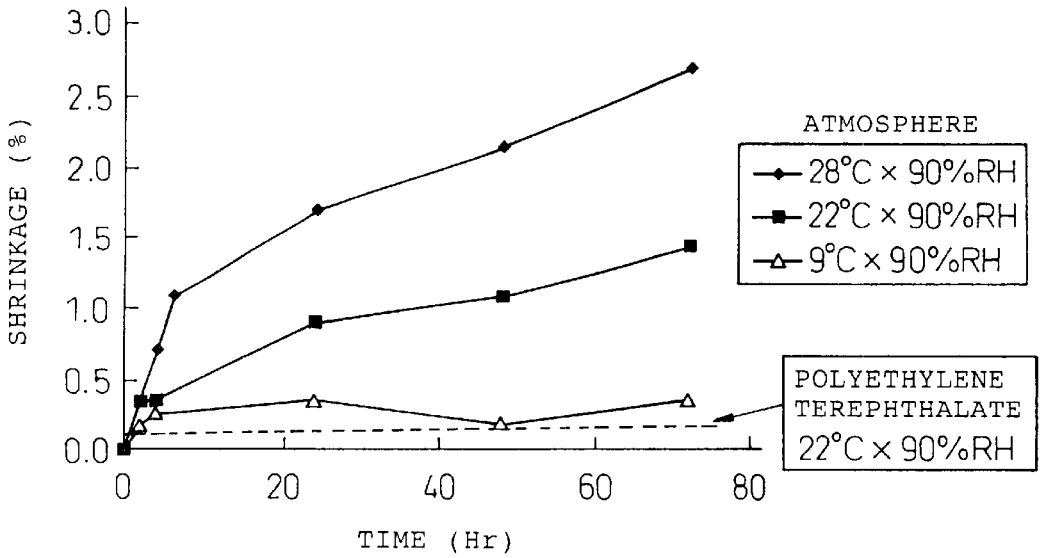
FIG. 1 is a graph representing the relationship between the atmospheric condition (temperature) and the shrinkage of PTT undrawn fiber with time (when the relative humidity is 90%)
Figure 2:
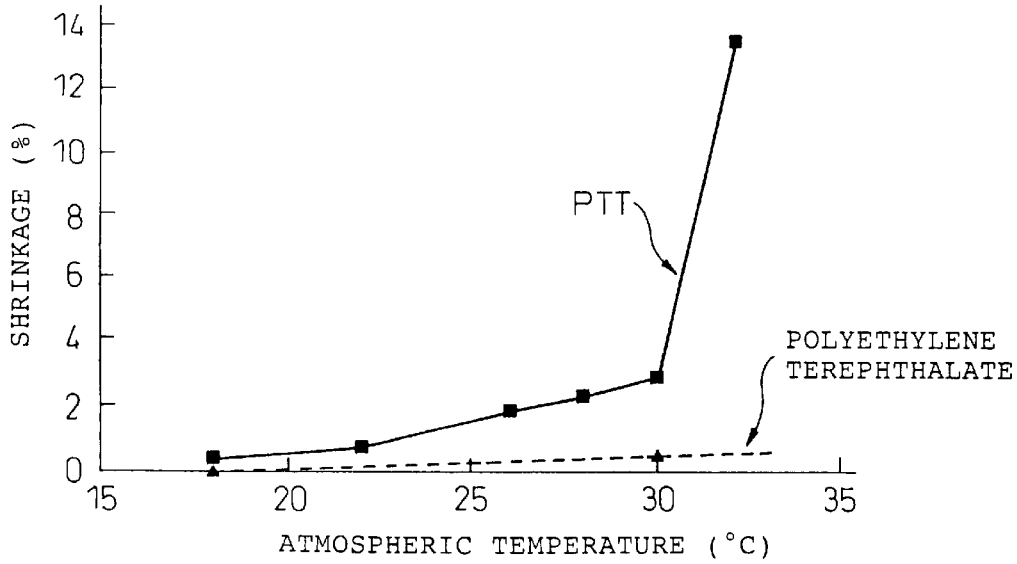
FIG. 2 is a graph representing the relationship between the atmospheric temperature and the shrinkage of PTT undrawn fiber (when the relative humidity is 90% and the time passage is 24 hours)
Figure 3A:
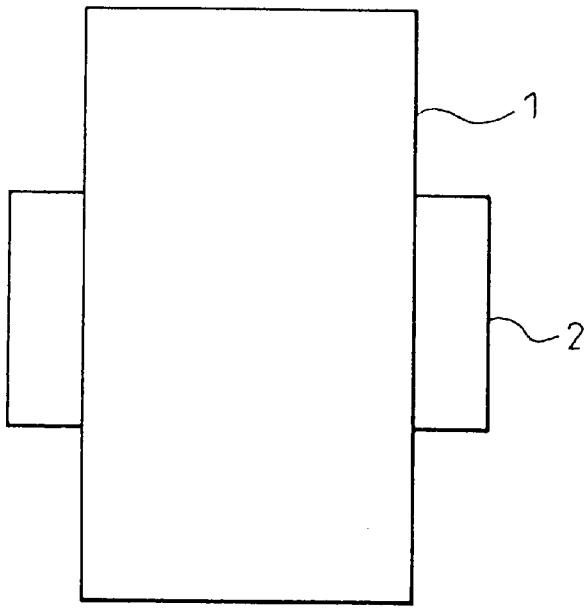
FIG. 3A is a schematic illustration of an undrawn fiber package in a normal shape.
Figure 3B:
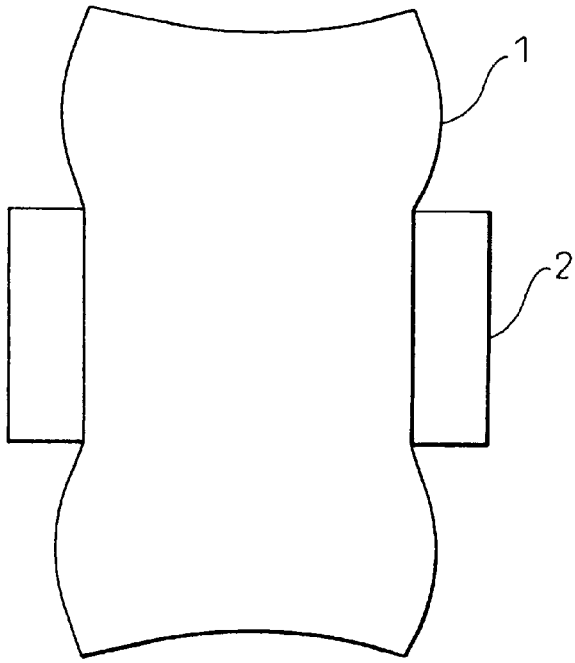
FIG. 3B is a schematic illustration of an undrawn fiber package transformed due to the shrinkage of the undrawn fiber with time.
Figure 4A:
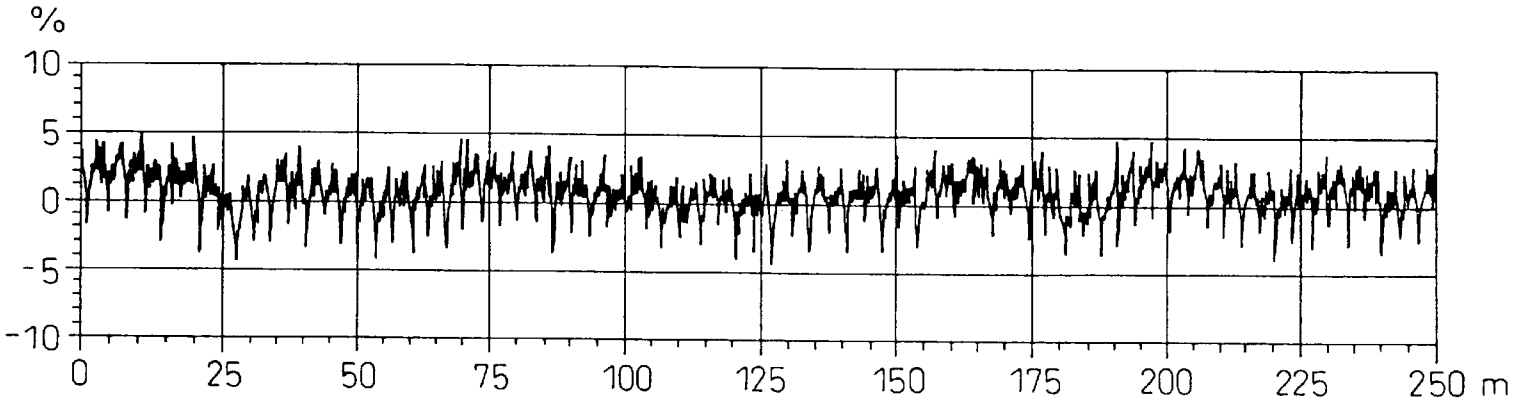
FIG. 4A is a U% chart of an evenness tester (Diagram Mass) wherein the periodic fluctuation on the smaller fiber size side is significant.

When the periodic fluctuation of fiber size is clearly observed from the chart as shown in FIG. 4A, an interval of the periodic fluctuation of fiber size and a ratio of a magnitude of the fluctuation to an average fiber size is read from the chart.

Figure 4B:
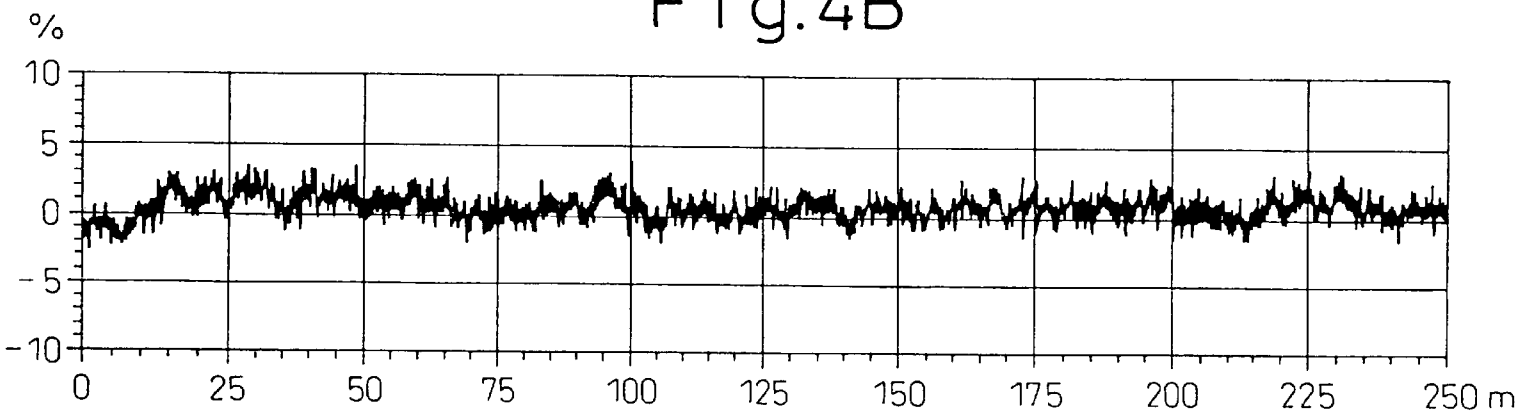
FIG. 4B is a U% chart of an evenness tester (Diagram Mass) wherein the periodic fluctuation on the smaller fiber size side is not significant.
Figure 5A:
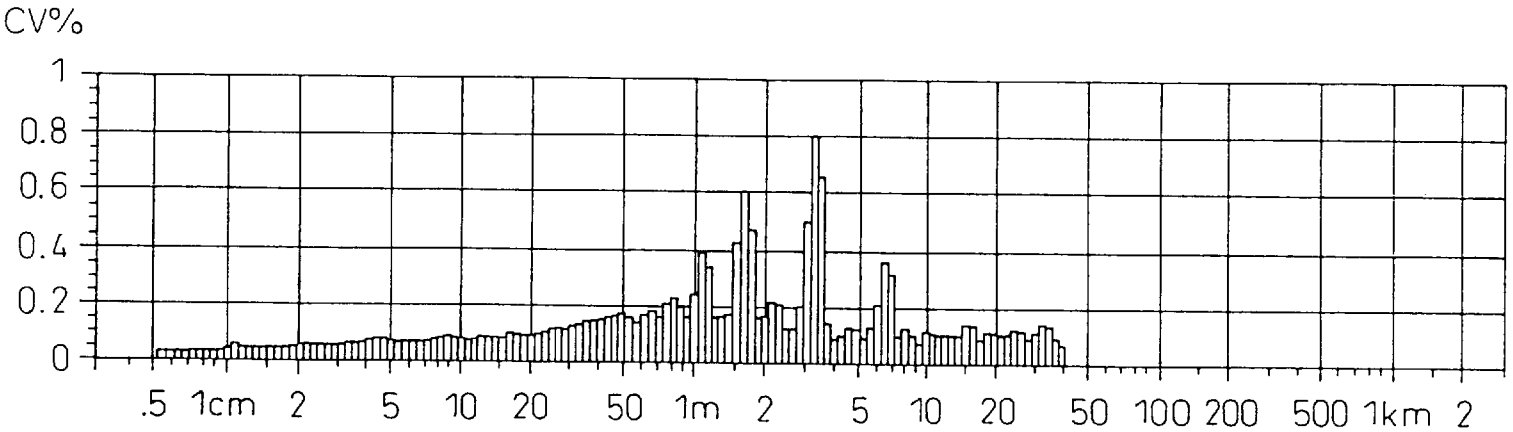
FIG. 5A is a periodic analysis diagram of fiber size variation (Spectrogram Mass) corresponding to FIG. 4A.
Figure 5B:
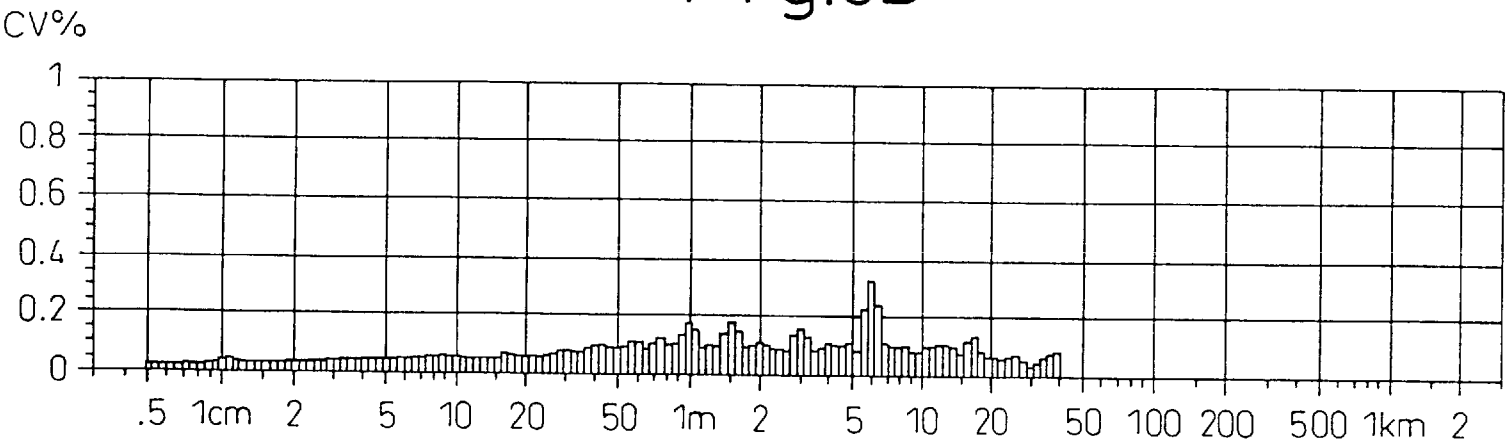
FIG. 5B is a periodic analysis diagram of fiber size variation (Spectrogram Mass) corresponding to FIG. 4B.

When the periodic fluctuation of fiber size is not clearly observed from the chart as shown in FIG. 4B, a period analysis diagram as shown in FIG. 5A or 5B, i.e., Spectrogram Mass (a diagram representing the periodicity of variance CV of the fluctuation of fiber size) is obtained by using a software for analyzing a period of fiber size belonging to the evenness tester, from which is determined whether or not there are mountain-like signals or the periodic fluctuation of fiber size and an interval of the occurrence if any.

(e) Dyeing Grade

The dyeing grade is determined by an expert in accordance with the following criteria.

Grade 5: most excellent (acceptable)

Grade 4: excellent (acceptable)

Grade 3: good (hardly acceptable)

Grade 2: inferior (unacceptable)

Grade 1: extremely inferior (unacceptable)

EXAMPLES 1 TO 4

COMPARATIVE EXAMPLES 1 AND 2

In this test series, the investigation was made on the influence of the atmospheric temperature in which the undrawn fiber is retained on the shrinkage of the undrawn fiber with time.

Figure 6:
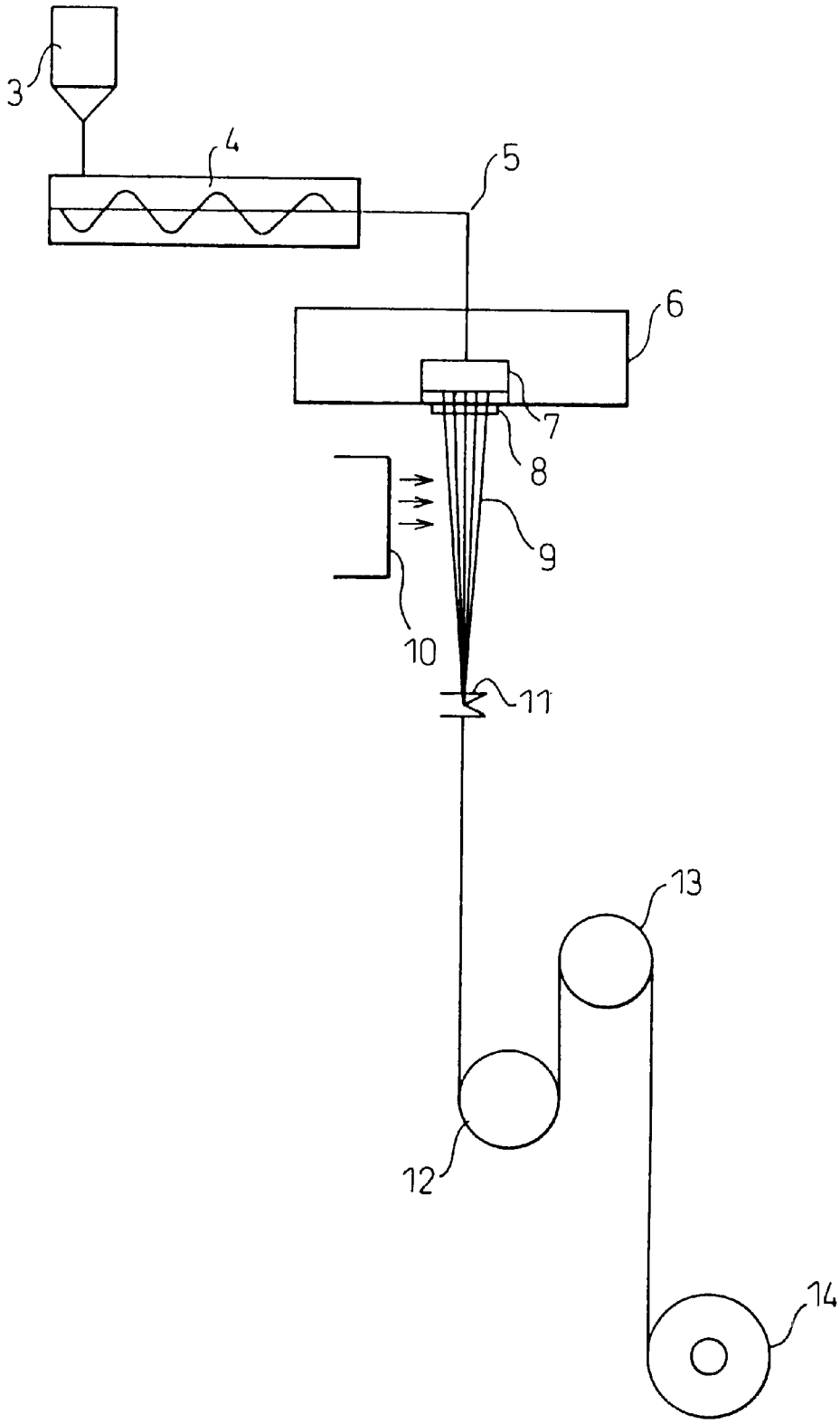
FIG. 6 is a schematic illustration of a spinning machine.
Figure 7:
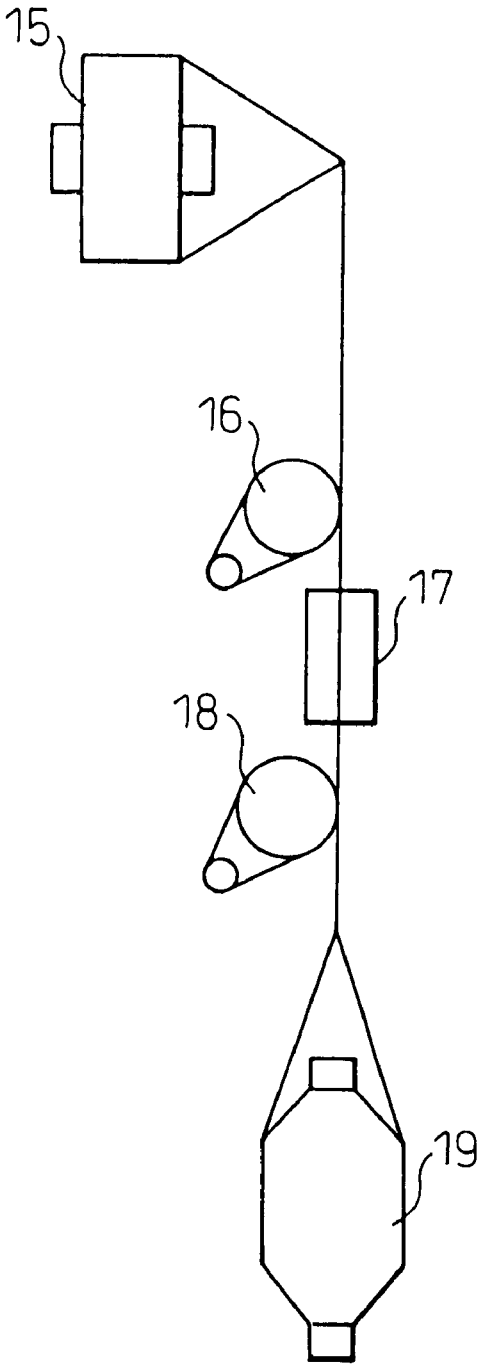
FIG. 7 is a schematic illustration of a draw twister.
Figure 8:
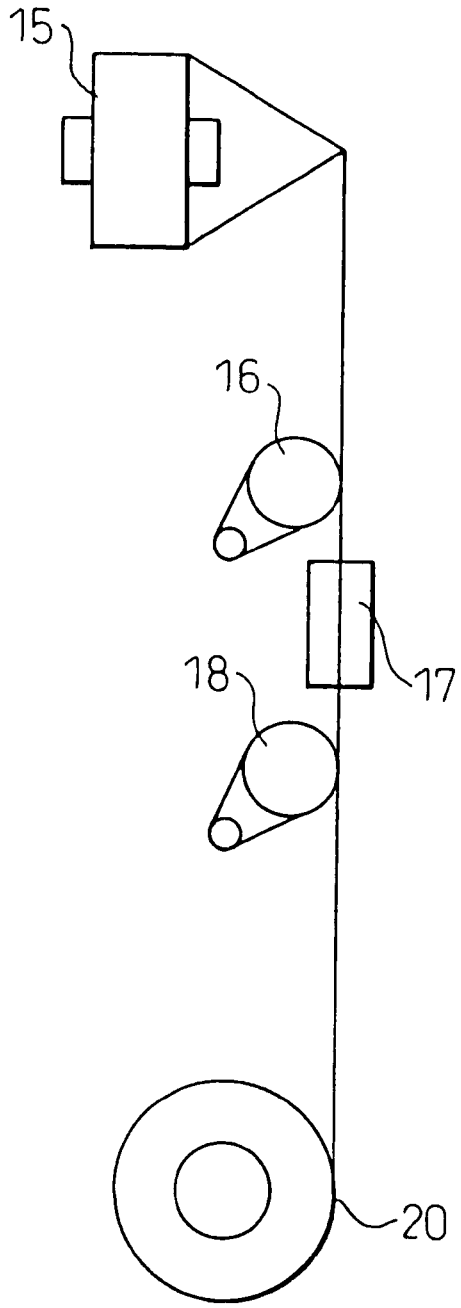
FIG. 8 is a schematic illustration of a draw winder.
Figure 9:
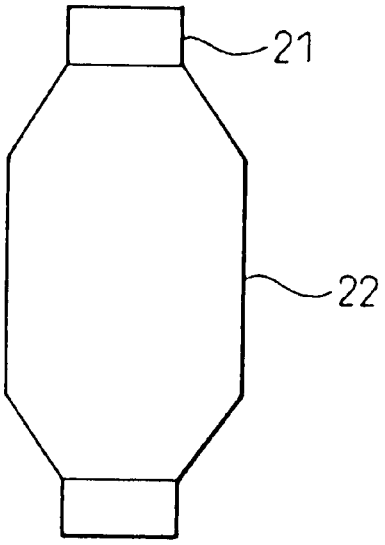
FIG. 9 is a schematic illustration of a pirn.
Figure 10:
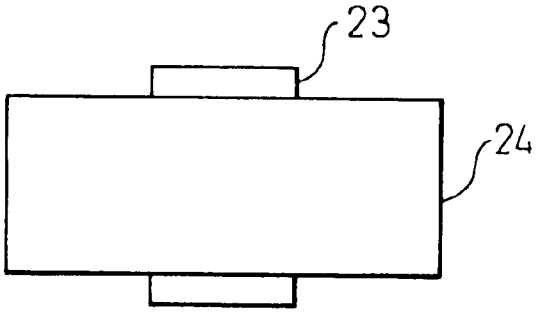
FIG. 10 is a schematic illustration of a cheese.

PTT fiber of 56 dtex/24 f was produced from PTT pellets having an intrinsic viscosity of 0.91 and containing 0.4 wt % of titanium oxide, through a spinning machine and a draw twister shown in FIGS. 6 and 7, respectively. This spinning machine was capable of mounting sixteen spinnerets, and therefore sixteen undrawn fibers were simultaneously prepared. In the drawing process subsequent thereto, the sixteen undrawn fibers thus prepared were simultaneously drawn.

The simultaneous preparation/drawing of these sixteen undrawn fibers was carried out while changing the atmospheric conditions. After the undrawn fibers have been wound (i.e., after 6 kg-weight packages have been formed) and further stored for 24 hours, the drawing process was carried out so that four 1.5 kg-weight packages are sequentially doffed from the respective 6 kg-weight package, wherein one hour was interposed between the respective doffs.

The undrawn fiber was retained in the atmosphere of the predetermined condition during the winding, storage and drawing processes. The atmospheric temperature was changed in a range from 28 to 15° C. (as shown in Table 1) while maintaining the relative humidity at 90%, under which condition the preparation of the undrawn fiber was carried out four times.

The spinning condition and the drawing condition were as follows:

Spinning Condition

Pellet drying temperature and aimed moisture content: 130° C., 25 ppm

Extruder temperature: 260° C.

Spin head temperature: 265° C.

Diameter of spinneret orifice: 0.24 mm

Discharge rate of polymer: 19 g/min/end

Cooling air condition: temperature of 22° C., relative humidity of 90% and air speed of 0.5 m/sec.

Finishing condition: 10% aqueous emulsion, an adhesion degree of 0.8 wt %

Take-up speed (peripheral speed of godet roll): 1500 m/min

Winding speed: Adjustment was made so that the winding tension is 0.07 cN/dtex.

Concentration & adhesion amount of finishing agent: 10% aqueous emulsion, 0.8 wt %.

Moisture content of undrawn fiber: 4.0 wt %

Weight of undrawn fiber package: 6 kg

Time necessary for forming the above package: 5.3 hours

Drawing Condition

Supply roll temperature of draw twister: 55° C.

Hot plate temperature of draw twister: 130° C.

Draw roll temperature of draw twister: not heated (room temperature)

Draw ratio: Adjustment was made so that an elongation at break of the resultant drawn fiber is approximately 40%.

Winding speed: 800 m/min

Weight of drawn fiber pirn: 1.5 kg

Time necessary for forming the above pirn: 5.8 hours

In this test series, sixteen undrawn fiber packages were simultaneously doffed six times in correspondence with the respective atmospheric conditions shown in Table 1, and the drawing experiment of 1.5 kg pirn×four times was carried out on the respective doff. As shown in Table 1, the degree of the transformation of undrawn fiber package and the number of yarn breakage due to unfavorable unwinding were estimated, and as shown in Table 2, the physical property and quality of the drawn fiber were estimated.

As is apparent from Table 1, in Comparative examples 1 and 2 wherein the atmospheric temperature is outside the definition of the present invention, the transformation of the undrawn fiber packages is large to result in many yarn breakages due to the unfavorable unwinding during the drawing process, while in Examples 1 to 4 wherein the atmospheric temperature is within the definition of the present invention, the transformation of the undrawn fiber packages is small to result in few yarn breakages caused by the unfavorable unwinding.

As is apparent from Table 2, the drawn fibers in Comparative examples 1 and 2 wherein the atmospheric temperature is outside the definition of the present invention have a large U% and a large periodic fluctuation of fiber size. Also the dyeing grade is 1 and 2 which are unacceptable. On the other hand, the drawn fibers in Examples 1 to 4 which are within the definition of the present invention exhibit a high uniformity, that is, they are favorable in U% and small in periodic fluctuation of fiber size as well as have acceptable dyeing grades of 3 to 5.

TABLE 1

| No. | Atmospheric condition Temperature ° C. | Relative humidity % | Package shape 24 hours after being wound | Number of yarn breakages due to unfavorable unwinding 1st doff 31.1 hr * | 2nd doff 39.2 hr * | 3rd doff 47.3 hr * | 4th doff 55.5 hr * | Total |
|---|---|---|---|---|---|---|---|---|
| Comparative example 1 | 28 | 90 | XX | 7 | 8 | 10 | 15 | 40 |
| Comparative example 2 | 26 | 90 | X | 7 | 7 | 9 | 11 | 34 |
| Example 1 | 24 | 90 | ○ | 1 | 2 | 1 | 3 | 7 |
| Example 2 | 22 | 90 | ◯ | 0 | 1 | 2 | 1 | 4 |
| Example 3 | 18 | 90 | ◯ | 0 | 1 | 1 | 1 | 3 |
| Example 4 | 15 | 90 | ◯ | 1 | 1 | 0 | 1 | 3 |

Note 1: ◯ very good, ○ good, X largely transformed, XX very largely transformed
Note 2: Number of yarn breakages due to unfavorable unwinding is the number of yarn breakages occurring during the drawing process of sixteen undrawn fiber packages caused by the unfavorable unwinding.
Note 3: In Table, * represents the maximum time lapse of the undrawn fiber drawn in that doff from the initiation of the winding to the completion of the drawing thereof (that is, a time for which the fiber exists as undrawn fiber).

TABLE 2

| No. | Fiber size dtex | Strength at break cN/dtex | Elongation at break % | Shrinkage in boiling water % | Peak value of heat shrinkage stress cN/dtex | Toughness (cN/dtex) $\%^{1/2}$ | U % | Magnitude of periodic variation of fiber size % | Dyeing grade |
|---|---|---|---|---|---|---|---|---|---|
| Comparative example 1 | 55.4 | 3.2 | 41.0 | 13.0 | 0.29 | 20 | 1.7 | 4 | 1 |
| Comparative example 2 | 55.4 | 3.2 | 40.4 | 12.9 | 0.28 | 20 | 1.6 | 3 | 2 |
| Example 1 | 55.0 | 3.4 | 39.1 | 12.8 | 0.30 | 21 | 1.3 | 2 | 3 |
| Example 2 | 54.9 | 3.4 | 38.2 | 13.1 | 0.30 | 21 | 0.9 | (2)* | 4 |
| Example 3 | 54.9 | 3.5 | 38.0 | 13.2 | 0.31 | 22 | 0.8 | (2)* | 5 |
| Example 4 | 54.9 | 3.4 | 38.9 | 13.4 | 0.30 | 21 | 0.8 | (3)* | 5 |

In Table, * represents a result of the period analysis of the fiber size fluctuation wherein (2) and (3) correspond to the requisites of the same numbers defined in claim 1.

EXAMPLES 5 TO 7

COMPARATIVE EXAMPLES 3 AND 4

In this test series, the investigation was made on the influence of the atmospheric relative humidity on the shrinkage of the undrawn fiber with time and the quality of the drawn fiber.

The tests were carried out in the same manner as in Example 2 except that the relative humidity is changed as shown in Table 3.

The transformation of the undrawn fiber packages and the number of yarn breakages were shown in Table 3, and the average physical property, the uniformity or others of the drawn fibers were shown in Table 4.

It is apparent from Table 4 that when the relative humidity was less than 75%, U% of the drawn fiber as well as the dyeing uniformity (dyeing grade) become worse.

Also, while there were extremely little fluff in the drawn fibers obtained by Examples 5 to 7, there were very much fluff in the drawn fibers obtained by Comparative examples 3 and 4.

TABLE 3

| | Atmospheric condition Temperature ° C. | Relative humidity % | Package shape 24 hours after being wound | Number of yarn breakages due to unfavorable unwinding 1st doff 31.1 hr * | 2nd doff 39.2 hr * | 3rd doff 47.3 hr * | 4th doff 55.5 hr * | Total |
|---|---|---|---|---|---|---|---|---|
| Example 5 | 22 | 95 | ◯ | 1 | 2 | 1 | 2 | 6 |
| Example 6 | 22 | 85 | ◯ | 1 | 1 | 1 | 2 | 5 |
| Example 7 | 22 | 75 | ◯ | 1 | 0 | 2 | 2 | 5 |
| Comparative example 3 | 22 | 70 | ◯ | 0 | 2 | 2 | 3 | 7 |
| Comparative example 4 | 22 | 60 | ◯ | 1 | 2 | 3 | 2 | 8 |

In Table, * represents the maximum time lapse of the undrawn fiber drawn in that doff from the initiation of the winding to the completion of the drawing thereof (that is, a time for which the fiber exists as undrawn fiber).

TABLE 4

| | Fiber size dtex | Strength at break cN/dtex | Elongation at break % | Shrinkage in boiling water % | Peak value of heat shrinkage stress cN/dtex | Toughness (cN/dtex) $\%^{1/2}$ | U % | Magnitude of periodic variation of fiber size % | Dyeing grade |
|---|---|---|---|---|---|---|---|---|---|
| Example 5 | 54.9 | 3.5 | 41.0 | 12.9 | 0.29 | 23 | 1.0 | (2)* | 4 |
| Example 6 | 54.8 | 3.4 | 40.8 | 12.9 | 0.27 | 22 | 0.9 | same | 4 |
| Example 7 | 55.0 | 3.4 | 39.8 | 13.1 | 0.27 | 21 | 1.3 | same | 3 |
| Comparative example 3 | 54.8 | 3.2 | 39.5 | 13.5 | 0.29 | 20 | 1.7 | same | 2 |
| Comparative example 4 | 55.1 | 3.0 | 40.1 | 13.0 | 0.30 | 19 | 1.8 | same | 2 |

In Table, * represents a result of the period analysis of the fiber size fluctuation wherein (2) corresponds to the requisites of the same numbers defined in claim 1.

EXAMPLES 8 TO 10

COMPARATIVE EXAMPLES 5 AND 6

In this test series, the investigation was made on the influence of the winding tension on the shrinkage of the undrawn fiber with time and the quality of the drawn fiber.

The tests were carried out in the same manner as in Example 2 except that the winding tension is changed as shown in Table 5.

The transformation of the undrawn fiber packages and the number of yarn breakages were shown in Table 5, and the average physical property, the uniformity or others of the drawn fibers were shown in Table 6.

As apparent from Tables 5 and 6, when the winding tension exceeds 0.12 cN/dtex, the transformation of the undrawn package is significant even if the atmospheric condition is within the definition of the present invention, and as a result, the drawing process is not smoothly carried out and the periodic variation on the smaller fiber size side is observed in the drawn fiber.

In this regard, the winding of the undrawn fiber was impossible when the winding tension is less than 0.04 cN/dtex.

TABLE 5

| | Winding | Package shape | Number of yarn breakages due to unfavorable unwinding | | | | |
|---|---|---|---|---|---|---|---|
| No. | tension cN/dtex | 24 hours after being wound | 1st doff 31.1 hr * | 2nd doff 39.2 hr * | 3rd doff 47.3 hr * | 4th doff 55.5 hr * | Total |
| Comparative example 5 | 0.16 | XX | 3 | 3 | 4 | 5 | 15 |
| Comparative example 6 | 0.13 | X | 2 | 3 | 3 | 4 | 12 |
| Example 8 | 0.11 | ○ | 1 | 1 | 2 | 2 | 6 |
| Example 9 | 0.08 | ○ | 1 | 1 | 1 | 2 | 5 |
| Example 10 | 0.04 | ○ | 0 | 1 | 1 | 1 | 3 |

In Table, * represents the maximum time lapse of the undrawn fiber drawn in that doff from the initiation of the winding to the completion of the drawing thereof (that is, a time for which the fiber exists as undrawn fiber).

TABLE 6

| | Fiber size dtex | Strength at break cN/dtex | Elongation at break % | Shrinkage in boiling water % | Peak value of heat shrinkage stress cN/dtex | Toughness (cN/dtex) $\%^{1/2}$ | U % | Magnitude of periodic variation of fiber size % | Dyeing grade |
|---|---|---|---|---|---|---|---|---|---|
| Comparative example 5 | 55.3 | 3.4 | 39.0 | 13.8 | 0.29 | 21 | 1.7 | 4.5 | 1 |
| Comparative example 6 | 55.4 | 3.4 | 38.8 | 12.9 | 0.30 | 21 | 1.6 | 3.0 | 2 |
| Example 8 | 55.0 | 3.4 | 40.2 | 13.3 | 0.30 | 22 | 1.1 | 2.0 | 3 |
| Example 9 | 54.9 | 3.4 | 40.9 | 13.0 | 0.29 | 22 | 0.9 | (2)* | 4 |
| Example 10 | 54.8 | 3.4 | 41.2 | 12.9 | 0.28 | 22 | 0.9 | (2)* | 4 |

In Table, * represents a result of the period analysis of the fiber size fluctuation wherein (2) corresponds to the requisites of the same numbers defined in claim 1.

EXAMPLE 11

PTT polymer containing titanium oxide of 0.05 wt % and having an intrinsic viscosity [η] of 0.90 was spun and drawn under the same process conditions as in Example 2. Results thereof were as follows:

Spinning and Drawing

Shape of the undrawn fiber package 24 hours after the winding; ○ (good)

Number of yarn breakages due to unfavorable unwinding (total number of four doffs); five times Physical properties and uniformity of raw yarn (average of five drawn yarns)

Fiber size: 54.8 dtex

Strength at break: 4.0 cN/dtex

Elongation at break: 40.2%

Toughness: 25 (cN/dtex)$\%^{1/2}$

Shrinkage in boiling water: 13.1%

Extreme value of thermal stress: 0.30 cN/dtex

U%: 0.8%

Periodic variation of fiber size: (2) (corresponding to the requisite (2) in claim 1)

Dyeing grade: 4

CAPABILITY OF EXPLOITATION IN INDUSTRY

PTT fiber according to the present invention is higher in toughness, smaller in fiber size fluctuation, i.e., U%, and in periodic variation of fiber size, whereby it is possible to obtain therefrom a knit or woven fabric having a high tenacity as well as a favorable dyeing uniformity as a whole.

Also, a method for producing PTT fiber according to the present invention is a two-step method consisting of a spinning/winding process of an undrawn fiber and a drawing process of the undrawn fiber subsequent thereto, which can minimize the transformation of an undrawn fiber package due to the shrinkage of undrawn fiber with time, and the unfavorable drawing and the fluctuation of fiber size of the drawn fiber caused thereby. Thus, PTT fiber excellent in uniformity is obtainable at a high yield.

What is claimed is:

1. A twisted or non-twisted polytrimethylene terephthalate fiber high in uniformity having an intrinsic viscosity in a range from 0.7 to 1.3, composed of 95 mol % or more of repeated units of trimethylene terephthalate and 5 mol % or less of those of other ester, characterized in that a toughness of the fiber is 19 (cN/dtex)$\%^{1/2}$ or more and a variation value of fiber size (U%) during the continuous measurement of the fiber size by an evenness tester is 1.5 or less as well as the fiber exhibits either one of characteristics defined by the following requisites (1), (2) and (3);

(1) a periodic variation on the smaller fiber size side at an interval of 10 m or less exists in an evenness tester chart, and a magnitude of the variation is 2% or less of an average fineness, (2) while the existence of the periodic variation on the smaller fiber size side at an interval of 10 m or less is not discernible from the evenness tester chart, a periodic variation at an interval of 10 m or less exists in a diagram for analyzing the period of fiber size variation, and (3) no periodic variation on the smaller fiber side at an interval of 10 m or less is discernible from the evenness tester chart, and no periodic variation at an interval of 10 m or less exists in the diagram for analyzing the period of fiber size variation;

(Note the toughness is calculated from the equation of strength at break×elongation at break $^{1/2}$ (cN/dtex) $\%^{1/2}$, and a length of fiber to be measured by the evenness tester is 250 m).

2. A polytrimethylene terephthalate fiber high in uniformity defined by claim 1, wherein the variation value of fiber size (U%) is 1.2 or less and the fiber exhibits the characteristic defined by the requisite (2) or (3).

3. A method for producing a fiber from polytrimethylene terephthalate having an intrinsic viscosity in a range from 0.7 to 1.3, composed of 95 mol % or more of repeated units of trimethylene terephthalate and 5 mol % or less of those of other ester by a two-step method wherein an undrawn fiber is once taken up in a spinning process as a package form at a take-up rate of 1900 m/min or less and then drawn in a drawing process, characterized in that the undrawn fiber is taken up at a take-up tension in a range from 0.04 to 0.12 cN/dtex, and retained in an environmental atmosphere having a temperature in a range from 10 to 25° C. and a relative humidity in a range from 75 to 100% during a winding process, a storage process and a drawing process, and in that the drawing of the undrawn fiber is completed within 100 hours after the undrawn fiber has been taken up.

* * * * *